United States Patent [19]

Török et al.

[11] Patent Number: 5,006,761

[45] Date of Patent: Apr. 9, 1991

[54] AIR TRANSPORTING ARRANGEMENT

[75] Inventors: Vilmos Török, Lidingö ; Andrzej Loreth, Åkersberga, both of Sweden

[73] Assignee: Astra-Vent AB, Stockholm, Sweden

[21] Appl. No.: 199,258

[22] PCT Filed: Dec. 2, 1986

[86] PCT No.: PCT/SE86/00548

§ 371 Date: May 27, 1988

§ 102(e) Date: May 27, 1988

[87] PCT Pub. No.: WO87/04020

PCT Pub. Date: Jul. 2, 1987

[30] Foreign Application Priority Data

Dec. 20, 1985 [SE] Sweden ..... 8506067

[51] Int. Cl.[5] ..... H01J 7/24; H01T 23/00

[52] U.S. Cl. ..... 315/111.91; 417/48; 430/937; 261/DIG. 42; 313/231.41

[58] Field of Search ..... 315/111.21, 111.01, 315/111.91, 111.81; 313/231.41, 7, 359.1, 103 R, 233; 261/DIG. 42; 430/937; 417/48, 49

[56] References Cited

U.S. PATENT DOCUMENTS

| | | | |
|---|---|---|---|
| 2,765,975 | 10/1956 | Lindeblad | 315/111.91 |
| 3,361,337 | 1/1968 | Hurst | 315/111.91 |
| 3,751,715 | 8/1973 | Edwards | 417/48 |
| 4,210,847 | 7/1980 | Shannon et al. | 315/111.91 |
| 4,380,720 | 4/1983 | Fleck | 315/111.91 |
| 4,812,711 | 3/1989 | Torok et al. | 315/111.91 |

FOREIGN PATENT DOCUMENTS

| | | |
|---|---|---|
| 0029421 | 5/1981 | European Pat. Off. . |
| 2538958 | 3/1977 | Fed. Rep. of Germany . |
| 2854716 | 6/1980 | Fed. Rep. of Germany . |
| 8607500 | 12/1986 | Sweden . |
| 2112582 | 7/1983 | United Kingdom . |

*Primary Examiner*—Eugene R. LaRoche
*Assistant Examiner*—Michael B. Shingleton
*Attorney, Agent, or Firm*—Browdy and Neimark

[57] ABSTRACT

An arrangement for transporting air with the aid of an electric ion wind comprises a corona electrode (K) and a target electrode (M) located downstream of the corona electrode. A d.c. voltage source (3) has its terminals connected to the corona electrode and the target electrode, respectively, so that a corona discharge is generated at the corona electrode. The corona electrode (K) includes one or more wirelike electrode elements (4) located adjacent the symmetry axis of the air-flow path (1) and having, as seen in a direction perpendicular to the symmetry axis, an extension which is substantially much smaller than the cross dimension of the airflow path. The wirelike electrode elements (4) lack free, unattached ends at which the field strength exceeds the field strength at the peripheral surface of the electrode elements, thereby avoiding punctiform corona-discharge concentrations and confining the corona discharge to the peripheral surface of the electrode elements.

9 Claims, 2 Drawing Sheets

AIR TRANSPORTING ARRANGEMENT

BACKGROUND OF THE INVENTION

Description of the Related Art

Figure 1:
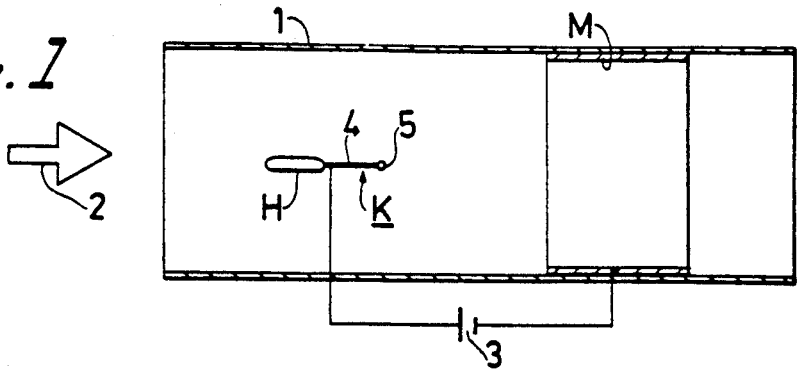

The present invention relates to an arrangement for transporting air with the aid of a so-called ion wind or corona wind and being of the kind set forth in the pre-characterizing clause of claim 1.

It is known that air can be transported, in principle, with the aid of a so-called electric ion-wind or corona-wind. An ion wind is created when a corona electrode and a target electrode are mutually spaced apart and connected to a respective terminal of a d.c. voltage source, and when the construction of the corona electrode and the voltage of the d.c. voltage source are such as to give rise to a corona discharge at the corona electrode. This corona discharge, in turn, gives rise to air ions of the same polarity as the polarity of the corona electrode, and possibly also to electrically charged aerosols, i.e. air suspension of solid particles or liquid droplets which are charged electrically as a result of collision with the electrically charged air ions. The air ions migrate rapidly, under the influence of the electric field, from the corona electrode to the target electrode, where they relinquish their electric charge and return to electrically neutral air molecules. During their movement between the electrodes, the air ions constantly collide with the electrically neutral air molecules, thereby transferring electrostatic forces thereto, so that said air molecules are also drawn in a direction from the corona electrode towards the target electrode, thereby effecting transportation of air in the form of a so-called ion wind, or corona wind.

Earlier proposed air transporting arrangements based on the electric ion-wind concept are found described, for example, in DE-OS 2854716, DE-OS 2538959, GB-A-2112582, EP-A1-29421 and US 4,380,720. These earlier proposed arrangements, however, have been shown to be highly ineffective and have not obtained any practical significance. Air transporting arrangements which are based on the ion wind concept and which display marked improvements over the earlier proposed arrangements, both in regard to efficiency and to practical utility, are described in our contemporary international patent application PCT/SE85/00538.

A common feature of all of the aforesaid arrangements is that a corona electrode and a target electrode are arranged spaced from one another in the desired direction of air flow, the corona electrode and the target electrode both being constructed so that air can pass therethrough. The target electrode is placed downstream of the corona electrode, as seen in the direction of air flow, and a source of d.c. voltage is connected between the corona and target electrodes, the voltage of the d.c. voltage source and the construction of the corona electrode being such as to create at the corona electrode a corona discharge which will produce air ions. In all of the aforementioned cases the electrodes are arranged within the confines of an airflow duct, although when such an arrangement is constructed in accordance with our aforesaid international application the provision of such a duct is not an unavoidable necessity, as is made clear in the aforesaid international application.

The corona electrodes hitherto proposed for use with air transporting arrangements of this kind can be divided into two main categories, namely a first category in which the corona electrode comprises an elongated, substantially wire-like corona element which is intended to extend across the airflow path, and a second category in which the corona electrode comprises pointed corona elements, for example corona elements in the form of short, thin wires or needle-like devices which extend axially in the airflow path, with one end of the element secured in a holder and the other, pointed end, which is unattached, being directed towards the target electrode.

One requirement placed on the corona electrode of an air transporting arrangement of the kind in question is that the corona discharge created at said electrode gives rise to the greatest possible transportation of air. Another requirement is that the corona discharge is stable and creates but the smallest possible amount of toxic gases, primarily ozone and oxides of nitrogen.

SUMMARY OF THE INVENTION

The object of the present invention is to provide an air transporting arrangement of the aforementioned kind having a corona electrode so constructed as to fulfill the aforementioned requirements more fully than do the corona electrodes hitherto proposed for use in such arrangements.

The invention is based on the experimental discovery that, when compared with an elongated, wire-like corona electrode that extends transversely across the entire cross-section of the airflow path, the transportation of air can be greatly improved when the corona electrode is constructed and arranged in a manner such as to confine the corona discharge to a minor, central part of the cross-section of the airflow path. This is particularly applicable with airflow paths of, for example, circular cross-section or similarly shaped cross-sections. The use of a short wire-like or needle-like corona electrode arranged axially in the centre of the airflow path with the free, unattached end, or point, of the corona electrode directed towards the target electrode, as previously proposed in air transporting arrangements of the kind in question, is accompanied with other, very serious problems, however. When such a needle-like corona electrode is operated with an electrically positive corona discharge, the corona discharge becomes unstable, due to the formation of long, wire-like corona discharge channels, so-called streamers, in the surrounding air. Consequently, it is not possible to utilize a positive corona discharge from such needle-like corona electrodes over long periods of time. Although this problem does not occur in the same manner when a needle-like corona electrode is operated with an electrically negative corona discharge, a negative discharge will result in the production of very large quantities of toxic gases, such as ozone and oxides of nitrogen, and hence it is not possible to utilize strong negative corona discharges in air transporting arrangements of the kind in question, when these arrangements are intended for use in populated environments.

The aforementioned requirements placed on a corona electrode intended for use in an air transporting arrangement of the kind in question are fulfilled in accordance with the invention by means of a corona electrode that incorporates at least one substantially wire-like electrode element which is arranged adjacent the symmetry axis of that part of the airflow path in which the corona electrode is to provide for the supply of air ions, and which is so constructed and orientated that its extension in a direction perpendicular to said symmetry axis is essentially much smaller than the cross-dimensions of said part of the airflow path, and in which corona electrode the wire-like corona element is so formed and arranged that it lacks ends at which the field strength exceeds the field strength at the peripheral surface of the electrode element and at which punctiform corona discharges could possibly occur, whereby the corona discharge is confined to the peripheral surface of electrode element.

The characterizing features of the invention and of advantageous embodiments and further developments thereof are set forth in the following claims.

The invention will now be described in more detail with reference to the accompanying drawings, in which FIGS. 1–7 illustrate schematically a number of mutually different embodiments of an air transporting arrangement constructed in accordance with the invention.

FIG. 1 illustrates schematically a first embodiment of an air transporting arrangement according to the invention which comprises airflow duct 1, the desired direction of airflow of which is indicated by an arrow 2 and which has a corona electrode K and a target electrode M arranged therein. The corona electrode K and the target electrode M are each connected to a respective terminal of a d.c. voltage source 3. In the illustrated embodiment it is assumed that the airflow duct 1 is of tubular construction, with a circular or like cross-sectional shape, the target electrode M having the form of a cylinder of corresponding shape to the airflow duct 1 and, in the illustrated embodiment, being located closely adjacent the wall of the airflow duct 1 or having the form of an electrically conductive coating applied directly to the inner surface of said wall. In principle, the arrangement operates in the same manner as the arrangement described in the aforementioned contemporary international patent application, i.e. a corona discharge is created at the corona electrode K and gives rise to air ions which, under the influence of the electric field, migrate from the corona electrode K to the target electrode M, thereby giving rise to the desired flow of air in the duct 1.

In accordance with the present invention, the corona electrode K of the embodiment illustrated in FIG. 1 comprises a substantially rectilinear wire 4 of electrically conductive material, the wire being positioned axially in the airflow duct 1 and preferably located along the symmetry axis of said duct. The upstream end of the wire-like electrode element 4 is attached to a holder H, which is carried in a suitable manner (not shown) in the airflow duct 1, while the downstream end of the electrode element 4 directed towards the target electrode M is provided with a bulbous body, or dropletlike body 5, which may comprise an electrically conductive or electrically insulating material and which has a substantially larger diameter than the diameter of the wire 4. This body 5, hereinafter referred to as the terminal body, prevents the occurrence of a field concentration and therewith a concentration of the corona discharge on the end of the wire-like corona element 4 facing towards the target electrode M. Instead, there is obtained a corona discharge which is spread over the peripheral surface of the electrode element 4 in the manner desired, in the central part of the cross-sectional area of the airflow duct 1, so as to eliminate the disadvantages encountered with the pointed or needle-like corona electrodes hitherto proposed.

Figure 2:
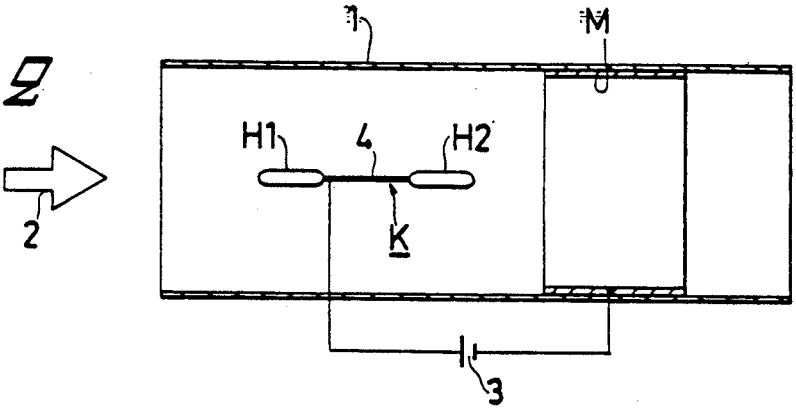

FIG. 2 illustrates another embodiment of the invention, in which the corona electrode K comprises a wire-like corona element 4 which although arranged in a similar manner to the corona electrode of the FIG. 1 embodiment has both ends attached to respective electrode holders H1 and H2. Because the wire-like electrode element 4 of this embodiment has no free ends, i.e. both ends are attached, the concentration of punctiform corona discharges are effectively avoided, and the corona discharge occurs instead over the peripheral surface of the electrode element 4 in the manner desired.

Figure 3:
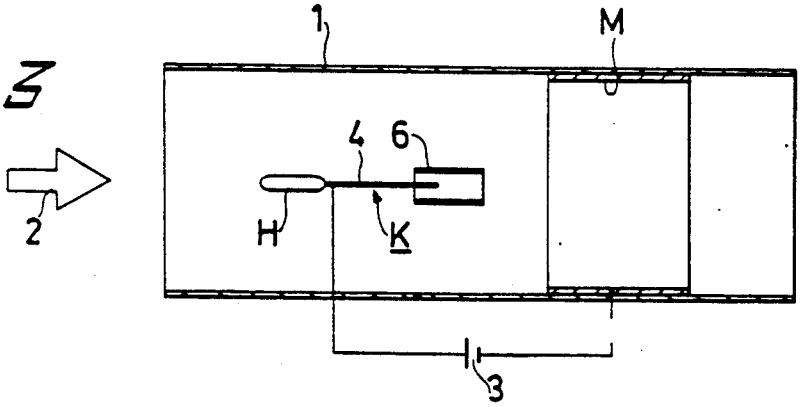
Figure 4:
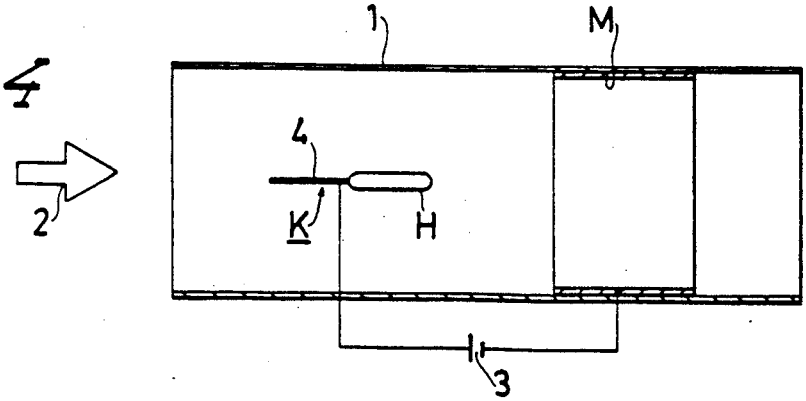

In the embodiment of the invention illustrated schematically in FIG. 3, the downstream end of the wire-like electrode element 4 of the corona element K facing towards the target electrode M is surrounded by a tube or sleeve 6, which is operative in screening the end of the electrode wire so that no field concentration, and thus no concentrated corona discharge, can occur on said end of the electrode wire 4. This screening of the end of the electrode wire 4 can also be achieved with screening elements having a configuration different to the tube 6.

It will be understood that corona electrodes K constructed in the manner illustrated by way of example in FIGS. 1 and 3 can, in principle, be reversed to no disadvantage, so that the holder H of the electrode wire 4 is located downstream, i.e. nearest the target electrode M, while the end of the electrode wire 4 provided with the terminal body 5 or the screening element 6 faces upstream, i.e. away from the target electrode M. However, no large field concentrations normally occur at the upstream facing free end of a wire electrode, i.e. a free end facing away from the target electrode M, and hence there is no serious risk of a concentrated corona discharge occurring. Consequently, the corona electrode may conceivably be given the form illustrated by way of example in FIG. 4, in accordance with the invention. In this case, the corona electrode K also comprises a wire-like electrode element 4, the downstream end of which facing towards the target electrode M is secured in a holder H, while the free, unattached end of the wire 4 faces upstream, away from the target electrode M. The risk of a punctiform corona discharge concentration at this free end of the electrode wire 4 is very small. Naturally, if desired, a terminal body of greater diameter than the diameter of the electrode wire 4 can be provided on the upstream facing end of the electrode wire 4.

Figure 5:
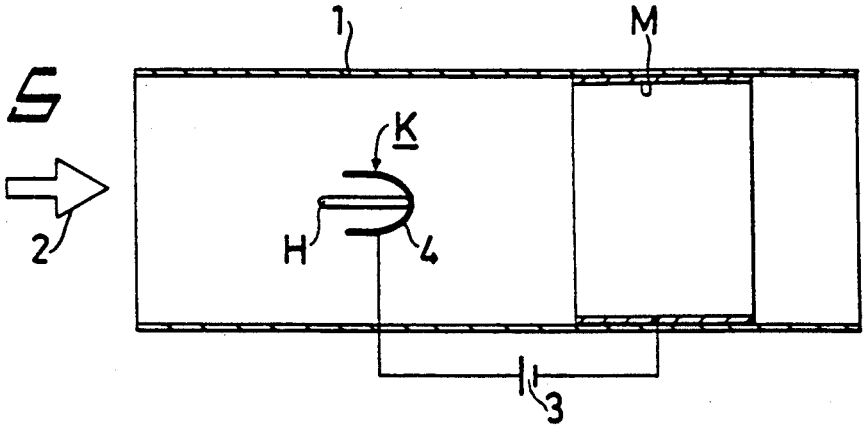

A further, conceivable embodiment of the invention is illustrated schematically in FIG. 5. In this embodiment, the corona electrode K comprises a substantially U-shaped, thin electrode wire 4, which is attached to a holder H in a manner such as to leave both ends of the electrode unattached, these ends being directed upstream, away from the target electrode M. If desired, these free ends of the electrode wire 4 may be provided with terminal bodies in the aforedescribed manner.

Figure 6:
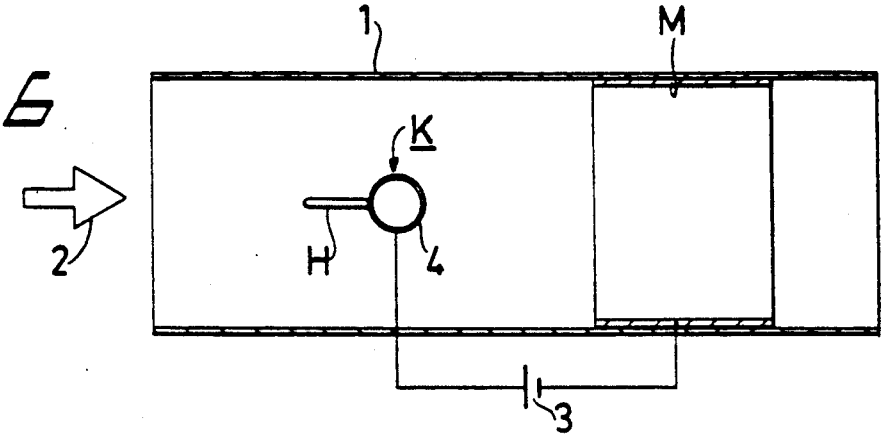

Another, conceivable embodiment of the invention is illustrated schematically in FIG. 6. In this embodiment, the corona electrode K comprises a wire-like electrode element 4 which has the shape of a ring or a loop and which is attached to a holder H. Since both ends of the wire-like electrode 4 of this embodiment are held attached, no concentrated or punctiform corona discharges can take place. The ring-shaped or loop-shaped electrode element can also be orientated in a plane extending perpendicular to the longitudinal axis of the airflow duct 1.

Figure 7:
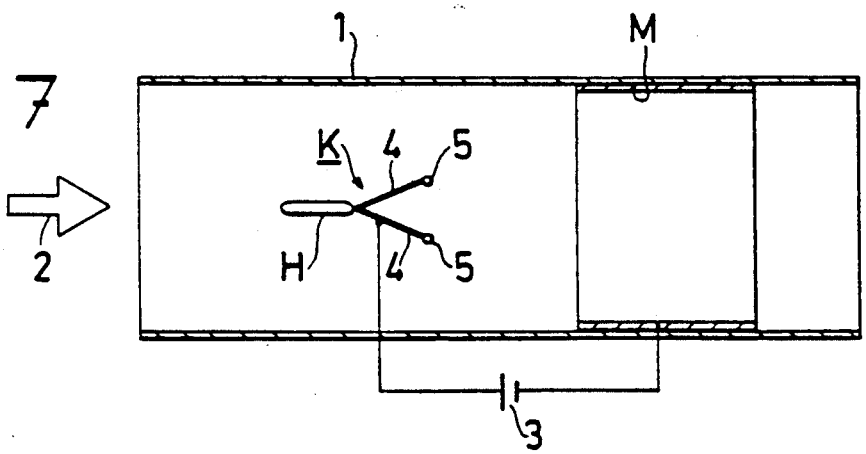

A corona electrode according to the invention may also comprise a plurality of electrode elements, for example in the manner illustrated schematically in FIG. 7. The corona electrode K of the FIG. 7 embodiment comprises two or more wire-like electrode elements 4 which are attached at one end thereof to the holder H and which are arranged around the peripheral surface of an imaginary symmetrical cone, the symmetry axis of which coincides with the axis of the airflow duct 1. The ends of the wire-like electrode elements 4 facing towards the target electrode M are provided with terminal bodies 5, in a manner similar to the embodiment illustrated in FIG. 1, which prevent concentrated corona discharges on the ends of the electrode wires 4. The top angle of the imaginary cone, around the peripheral surface of which the electrode wires 4 are arranged, can be varied and in the extreme case may be as large as 180°, such that the electrode wires 4 lie in one and the same plane at right angles to the longitudinal axis of the airflow duct 1.

An embodiment of the corona electrode K illustrated in FIG. 7 can also be reversed, so that the unattached ends of the electrode wires 4 are directed upstream, away from the target electrode M, in which case the terminal bodies 5 may optionally be omitted without risk of concentrated, punctiform corona discharges occurring at the ends of the electrode wires 4.

It will be evident from the aforegoing that a corona electrode according to the invention may have a number of different forms. The only essential feature of the electrode is that it comprises one or more wire-like electrode elements arranged within the central part of the cross-sectional area of the airflow path and that these electrode elements have, when seen perpendicular to the longitudinal axis of the airflow path, an extension which is essentially much smaller than the cross-dimension of said airflow path, preferably at most 25% of the cross-dimension of said path, and that the wire-like electrode elements lack ends at which the electric field strength exceeds the field strength at the peripheral surface of respective electrode elements, so as to avoid punctiform corona-discharge concentrations at said electrode element ends, and to confine the corona discharge to the peripheral surfaces of the electrode elements.

The invention has been described in the aforegoing with reference to an arrangement which incorporates a tubular airflow duct of circular cross-sectional area, or a cross-sectional area of similar configuration. The present invention can also be applied, however, in air transporting arrangements comprising an airflow duct of elongated rectangular or slit-like cross-sectional area, in which case a plurality of corona electrodes constructed in accordance with the invention are arranged in mutually spaced relationship in the symmetry plane of the airflow duct that contains the longitudinal axis of the elongated rectangular cross-sectional area of the airflow duct. Each such corona electrode will therewith provide for the production of air ions in an associated part of the total airflow duct.

The wire-like electrode elements of the corona electrode according to the invention are suitably manufactured from, or coated with a material which is resistant to ultraviolet radiation and ozone. The electrode element, for example, may comprise nickel-plated carbon-fibre wires.

In the aforegoing a detailed description of an air transporting arrangement according to the invention has been made solely with respect to the configuration of the corona electrode. With regard to the construction of the air transporting arrangement in other respects, reference is made to our contemporary international patent application mentioned in the aforegoing. Thus, the provision of a duct comprising physical walls surrounding the electrodes may be omitted. Furthermore, a suitable screen is arranged upstream of the corona electrode, so as to avoid the passage of an ion current upstream from the corona electrode, as described in the aforesaid international patent application. The arrangement may also be provided, to advantage, with an excitation electrode, in accordance with the recommendations made in the aforesaid international application. The configuration and positioning of the various electrodes, and the supply of voltage thereto, can therewith be effected in accordance with said international patent application.

We claim:

1. An arrangement for generating a flow of air along an airflow path therefor with the aid of an electric ion-wind, comprising a corona electrode in said airflow path, at least one target electrode located in said airflow path downstream of and spaced from said corona electrode as seen in the axial extension of the airflow path and being permeable to a flow of air along said path, and a d.c. voltage source having a first terminal connected to said corona electrode and a second terminal connected to said target electrode for creating an air ion producing corona discharge at said corona electrode, said corona electrode including at least one wire-like electrode element located close to the symmetry axis of said airflow path and having such dimensions and such orientation that its extension in directions perpendicular to said symmetry axis is substantially much smaller that the total cross-sectional dimensions of said airflow path, and lacking ends at which the electrical field strength exceeds the electrical field strength at the peripheral surface of the electrode element, so as to avoid punctiform corona-discharge concentrations and to confine the corona discharge to the peripheral surface of the electrode element.

2. An arrangement as claimed in claim 1, wherein said corona electrode consists of a substantially rectilinear wire positioned with its longitudinal axis coinciding essentially with the symmetry axis of said airflow path with one end facing towards said target electrode and the opposite end facing away from said target electrode, said end facing towards said target electrode being provided with a body having dimensions which are substantially greater that the diameter of the wire.

3. An arrangement as claimed in claim 2, wherein said end of said corona electrode wire facing away from said target electrode is attached to an electrode holder.

4. An arrangement as claimed in claim 1, wherein said corona electrode consists of a substantially rectilinear wire positioned with its longitudinal axis coinciding essentially with the symmetry axis of said airflow path and with one end facing towards said target electrode and the opposite end facing away from said target electrode, and said end facing towards the target electrode being attached to an electrode holder.

5. An arrangement as claimed in claim 4, wherein said end of said corona electrode wire facing away from said target electrode is provided with a body having dimensions which are substantially greater than the diameter of the wire.

6. An arrangement as claimed in claim 1, wherein said corona electrode comprises a plurality of wires extending at one end thereof from a common electrode holder located substantially on the symmetry axis of said airflow path and diverging substantially symmetrically from said symmetry axis, the opposite unattached ends of said wires being provided with bodies of substantially larger dimensions that the diameter of the wires.

7. An arrangement as claimed in claim 1, wherein said corona electrode comprises a substantially rectilinear wire positioned with its longitudinal axis coinciding essentially with said symmetry axis and with one end facing towards said target electrode and the opposite end facing away from said target electrode, at least said wire end facing towards said target electrode being surrounded by a screening element preventing concentration of the electrical field at said wire end.

8. An arrangement as claimed in claim 1, wherein said corona electrode comprises a ring-shaped or loop-shaped wire lacking free ends.

9. An arrangement as claimed in claim 1, wherein said corona electrode comprises a substantially U-shaped wire positioned close to said symmetry axis with its ends facing away from said target electrode.

* * * * *